United States Patent [19]

Dorsey et al.

[11] Patent Number: 4,867,411

[45] Date of Patent: Sep. 19, 1989

[54] MANHOLE INVERT CASTING SYSTEM

[75] Inventors: Wayne W. Dorsey; James G. Thurston, both of Martinsburg, W. Va.

[73] Assignee: Valley Blox, Inc., Harrisonburg, Va.

[21] Appl. No.: 90,511

[22] Filed: Aug. 28, 1987

[51] Int. Cl.[4] ..... B28B 7/30

[52] U.S. Cl. ..... 249/11; 249/83; 249/102; 249/134; 249/145; 249/156; 249/177; 249/184

[58] Field of Search ..... 249/10, 11, 64, 83, 249/90, 102, 134, 139, 140, 142, 144, 145, 147, 149, 151, 155, 156, 165, 166, 160, 176, 177, 184, 219 R

[56] References Cited

U.S. PATENT DOCUMENTS

| | | | |
|---|---|---|---|
| 725,098 | 4/1903 | Learned | 249/11 |
| 1,145,228 | 7/1915 | Blayney | 249/11 |
| 1,560,811 | 11/1925 | De La Mare | 249/11 |
| 3,363,876 | 1/1968 | Moore | 249/184 |
| 3,545,718 | 12/1970 | Shale | 249/184 |
| 4,085,918 | 4/1978 | Wilkerson | 249/11 |
| 4,103,862 | 8/1978 | Moore | 249/53 R |
| 4,119,291 | 10/1978 | Polito | 249/11 |
| 4,143,849 | 3/1979 | Good | 249/145 |
| 4,177,229 | 12/1979 | Moore | 264/40.5 |
| 4,276,245 | 6/1981 | Ault | 264/46.5 |
| 4,278,229 | 7/1981 | Burlett | 249/11 |
| 4,318,880 | 3/1982 | McIntosh et al. | 264/267 |
| 4,422,994 | 12/1983 | Ditcher | 264/219 |
| 4,427,619 | 1/1984 | Peterson | 249/145 |
| 4,484,724 | 11/1984 | Srackangast | 249/11 |
| 4,565,347 | 1/1986 | Ditcher | 249/83 |
| 4,566,483 | 1/1986 | Ditcher | 137/372 |
| 4,685,650 | 8/1987 | Ditcher | 249/145 |

*Primary Examiner*—James Housel

*Attorney, Agent, or Firm*—Mason, Fenwick & Lawrence

[57] ABSTRACT

A plurality of invert forming mold members are bolted together and have their ends received in internal frames provided at adjacent pipe openings in a manhole. The mold members are formed of relatively thick and heavy polyurethane and are of U-shaped cross-section. A mold supporting plate is provided in each of the internal mounting frames and has an opening configured to matingly receive the endmost mold component. The mold components are provided in a variety of linear lengths, angular curved configurations and elevation changing members so that they can be associated to form inverts required for any particular manhole configuration. The assembly of mold members is extremely strong and rigid and does not require any additional internal bracing.

25 Claims, 6 Drawing Sheets

FIG. 13A
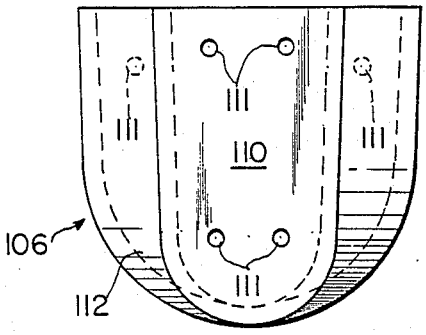
FIG. 14A
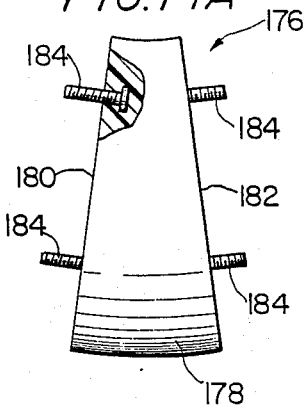
FIG. 14B
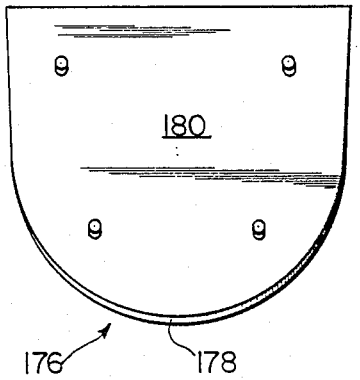
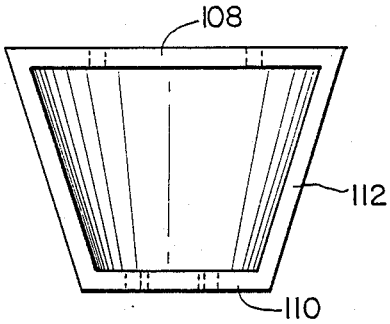
FIG. 13B
FIG. 15
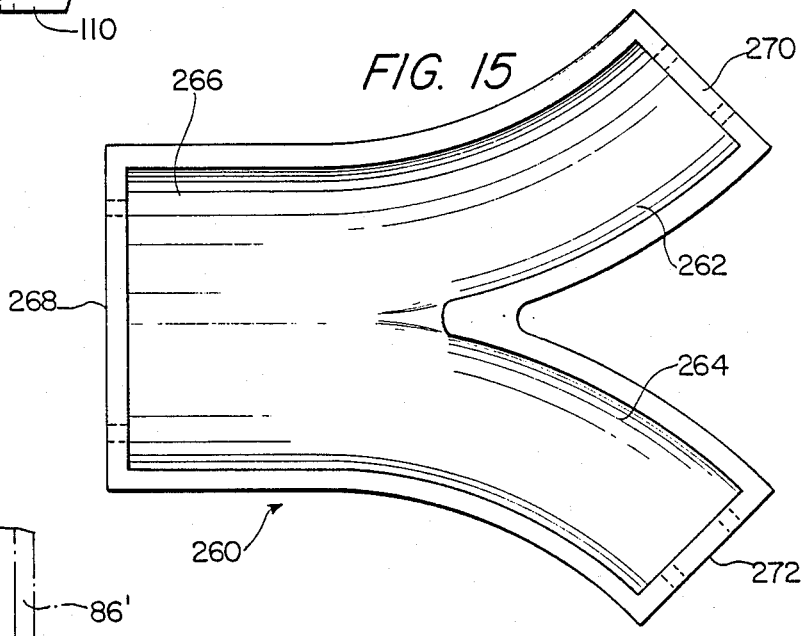
FIG. 16
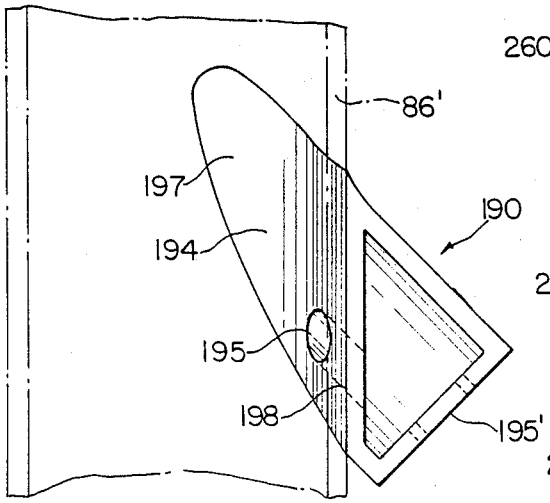
FIG. 17
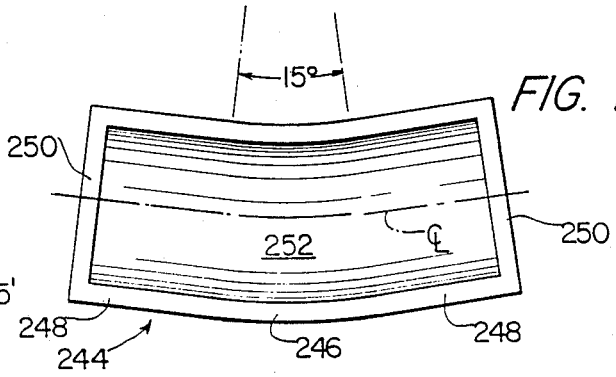

MANHOLE INVERT CASTING SYSTEM

BACKGROUND OF THE INVENTION

The present invention is in the field of manholes and is particularly directed to a novel and unique means for providing invert channels in the base of a manhole assembly through a two pour fabrication method which permits the obtainment of accurately positioned and aligned inverts for any type of flow system including plural inverts and junctures of different sized inverts flowing from pipes and oriented at different angles of inclination.

Conventional systems employed for handling sewage, storm drainage and the like employ vertically oriented manholes of generally cylindrical shape which are positioned at juncture locations of diverse flow pipes which discharge into the manhole with the manhole being provided with trough-like conduits referred to as inverts in its lower end portion. The inverts insure that the inwardly flowing material is directed into an outflow channel for subsequent movement downstream from the manhole. Inflow pipes frequently arrive at the manhole location at different elevations and are frequently of different sizes so that the formation of the necessary inverts is a complex and challenging endeavor.

Invert channels are frequently installed at the job site by hand forming and pouring, an operation which does not insure consistent uniformity, strength and appearance. Moreover, the field conditions under which such hand forming and pouring are performed are frequently adverse both from a technical sense and an economic sense. For example, it is essential that an adequate amount of mixed concrete be available at the job site in order for the invert channels to be properly formed. It is also obviously desirable that expensive concrete not be wasted and any miscalculation in the amount of concrete ordered which results in either a shortage or overage of concrete obviously increases the cost of the job. Moreover, the hand forming of invert channels requires skilled and expensive labor which is frequently difficult to obtain. Consequently, a number of devices have been proposed for the purpose of reducing the cost of providing manholes with invert channels and a number of such devices have been the subject of United States patents. The most relevant prior patents of which we are aware of U.S. Pat. Nos. 725,098; 1,145,228; 1,560,811; 3,363,876; 4,085,918; 4,103,862; 4,119,291; 4,177,229; 4,276,245; 4,278,229; 4,318,880; 4,422,994; 4,484,724; 4,565,347 and 4,566,483. Many of the prior art devices recognize the desirability of prefabricating manholes including inverts in a factory and while a number of the above patents represent a definite improvement over prior known hand forming techniques, they still suffer from a number of shortcomings including an inability to accommodate different sizes of invert channels, an inability to provide invert channels at different angles and inclinations. Some of the prior art devices are overly complex and difficult to use. Others are easily susceptible to damage and wear and must be frequently repaired or replaced. Others, such as U.S. Pat. No. 4,484,724 require additional bracing (i.e. means 56,62) to hold the invert molds in position against the buoyant forces of the wet concrete.

Factory construction of manholes is now widely employed with two types of systems being used. The first system, frequently referred to as a two-pour operation, involves a first pour of concrete for effecting the molding of the cylindrical side wall and a bottom wall, base or floor portion of a manhole with openings being provided in the side walls for connection to pipe members when the manhole is installed in the field. After the manhole wall and base construction has been cured, the inverts are molded in the lower portion of the cylindrical wall on the base portion by the positioning of U-shaped molding members extending across the width of the base of the system in the orientation required for the particular inflow openings of the particular manhole. A second pour of concrete is then poured into the bottom end of the manhole and is filled upwardly to a level generally adjacent the upper edges of the U-shaped molding members. A process of the aforementioned type is disclosed in U.S. Pat. No. 4,484,724. When the second pour of concrete has set, the invert channel forming molding members are removed to complete the manhole construction.

A second type of construction referred as a single-pour construction is also employed in a manhole factory. In the single-pour construction the manhole is cast in mold means which is in an inverted orientation as compared to the final manhole product in which the top of the mold member is provided with upward protrusions which define the invert to be formed in the manhole base. The mold includes concentric side walls which extend downwardly from the top of the mold member to define a cylindrical space which is filled with concrete which will eventually define the outer cylindrical wall of the manhole. Techniques for such single pour manhole forming operations are disclosed in U.S. Pat. Nos. 3,363,876; 4,103,862; 4,177,229; 4,422,994; and 4,565,347.

Therefore, it is the primary object of the present invention to provide a new and improved invert channel forming system.

A further object of the present invention is the provision of a new and improved invert channel forming system that is reliable, rugged and easy to use.

Yet another object of the present invention is the provision of a new and improved invert channel forming means that is versatile and can be used for forming invert channels of various sizes, shapes and angles of inclination.

Another object of the invention is the provision of an improved invert channel forming mold means not requiring the use of supplemental bracing for holding it in position.

SUMMARY OF THE INVENTION

Achievement of the foregoing objects of the present invention is enabled by the preferred embodiment in which a wide variety of channel forming invert mold components are provided for use in a two-pour molding operation.

More specifically, a plurality of invert mold members formed of polyurethane are provided with each of the mold members comprising a U-shaped trough portion extending lengthwise of the length of the invert to be formed and having transverse end walls at each end. The end walls extend all the way across the upper surface of each mold member in alignment with the upper edges of the U-shaped trough portion and both the trough portion and the end walls are formed of relatively thick polyurethane so that a heavy and rugged mold member is provided. The mold members come in various linear lengths and are connected together by bolts extending through aligned openings in the end walls of adjacent mold members.

A plurality of the mold members are bolted together to provide a composite mold having the length and dimensions for forming a main invert channel extending from an inflow opening in the cylindrical wall of a manhole to an opposite discharge opening in the cylindrical wall. Additionally, unique bracketing frame means is fastened to the cylindrical wall of the manhole at each opening for receiving the end piece mold members which do not have an end wall on their outer end and which are matingly received in an end support face plate having a central opening in which said end pieces are received The end piece invert mold members engage the internal frame means which support the end piece mold members and preclude their upward or lateral movement In one embodiment, the internal frame means is provided with a support that can rotate to adjust the composite mold members orientation about an axis extending along the length of the mold members.

In addition to linear mold members having varying degrees of curvature, the inventive system also includes curved mold members for effecting the formation of a curved invert, reducer mold members for forming an invert of a given size along a portion of its length and of a reduced or greater size along the remaining portion of its length. Additionally, solid riser or elevator section blocks are also employed for providing an inclination for a portion of an invert mold relative to other portions such as is necessary for joining an inlet opening at one elevation to a main outflow invert at a lower elevation. The joining of the molds for forming one invert flow channel joining with another flow channel is effected by the use of a merge juncture mold member having a canted end surface matingly engagable with the outer surface of a linear mold member to provide inverts in which one invert merges smoothly into the other invert.

The construction resultant from the bolting together of rigid heavy mold components is extremely strong and no additional bracing is required. Additionally, the system is extremely versatile in that the component parts can be selected for providing inverts in practically any conceivable manner in the lower end of the manhole. The inverts are actually formed by pouring of concrete into the lower end of the manhole after the mold system has been put into position After the concrete cures, the invert mold members are easily removed to permit completion of the construction.

BRIEF DESCRIPTION OF THE DRAWINGS

FIG. 13A is an end elevation view of a typical tapered component mold member used for forming a junction between an invert channel portion of one width to another channel portion of a different width;

FIG. 13B is a top plan view of the invert forming mold member of FIG. 13A;

FIG. 14A is a side elevation view of a riser or elevator section invert mold member used for joining inclined portions of the molding system which are oriented at different angles of inclination relative to the horizontal;

FIG. 14B is a end elevation view of the mold member of FIG. 14A;

FIG. 15 is a top plan view of an invert mold member employed for providing branching invert conduits; and FIG. 16 is a top plan view of a merge juncture invert mold member employed for smoothly joining a smaller diameter invert conduit to a larger outflow conduit; and FIG. 17 is a top plan view of a typical horizontally curved invert mold member.

DESCRIPTION OF THE PREFERRED EMBODIMENT

Figure 1:
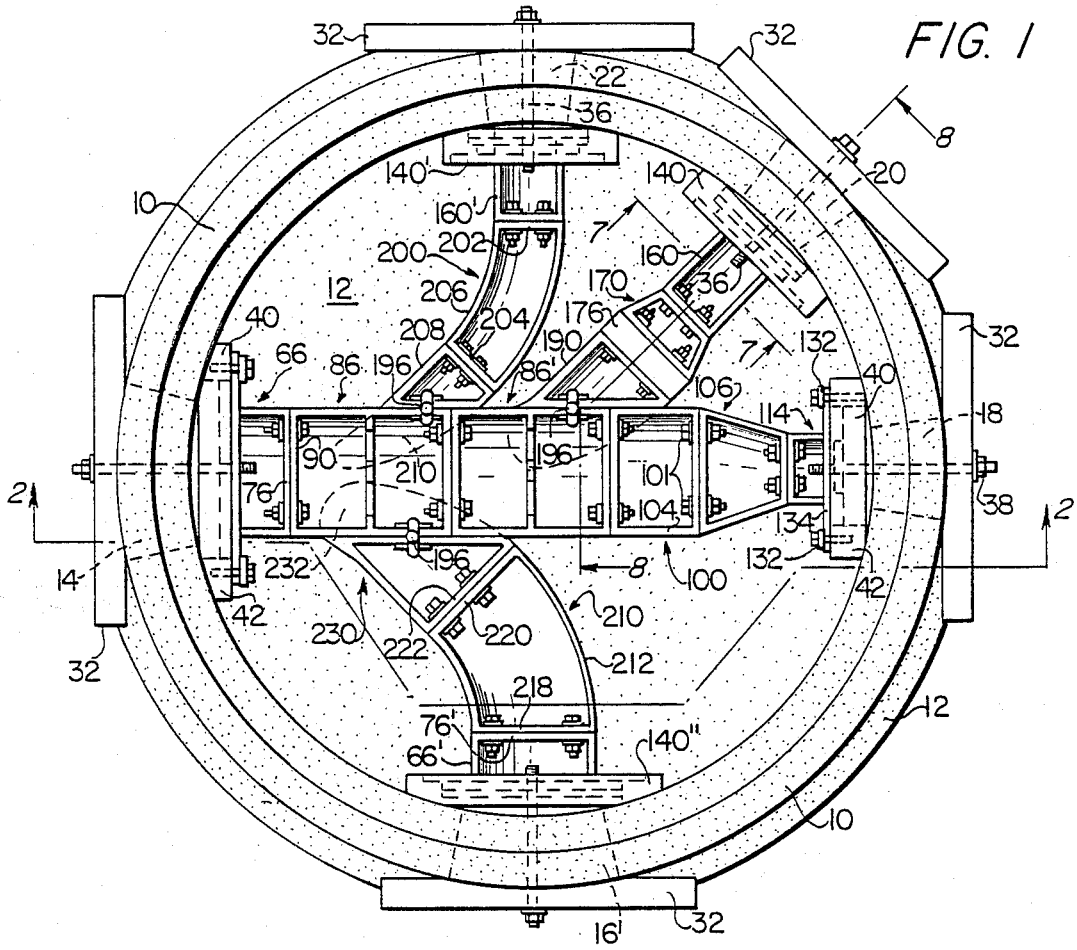
FIG. 1 is a top plan view of a typical use of portions of the preferred embodiment of the invention as used in forming plural inflow invert channels of different sizes, axial orientations and inclinations merging into a larger outflow channel.
Figure 2:
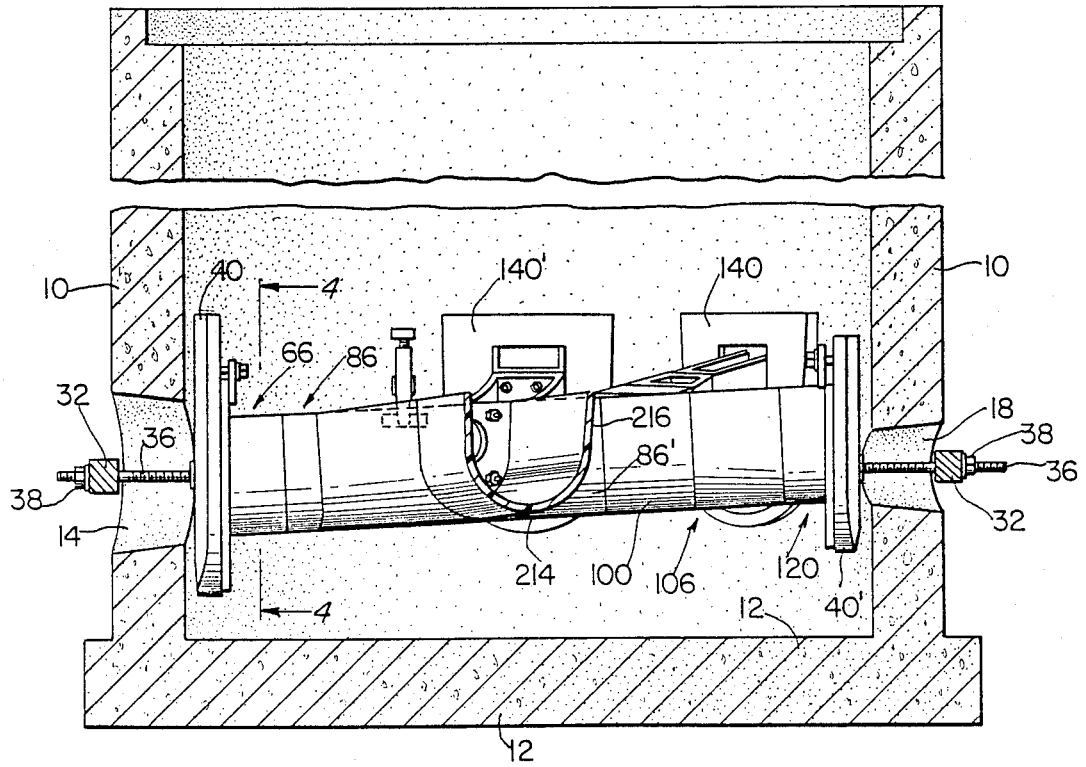
FIG. 2 is a sectional view taken along lines 2—2 of FIG. 1.
Figure 5:
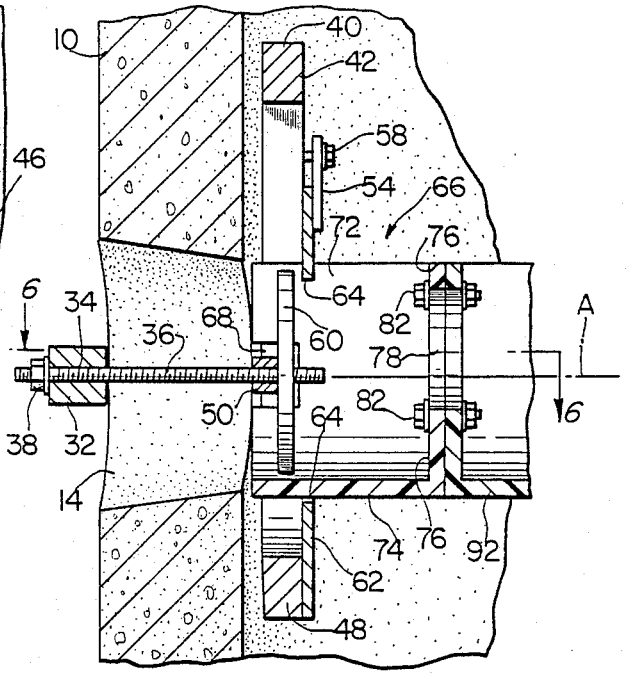
FIG. 5 is a sectional view taken along lines 5—5 of FIG. 4.
Figure 6:
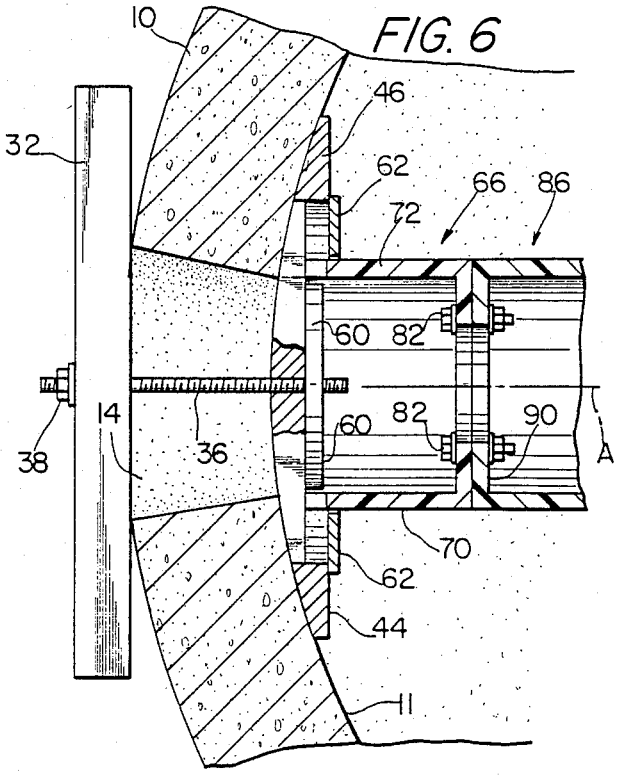
FIG. 6 is a sectional view taken along lines 6—6 of FIG. 5.
Figure 10:
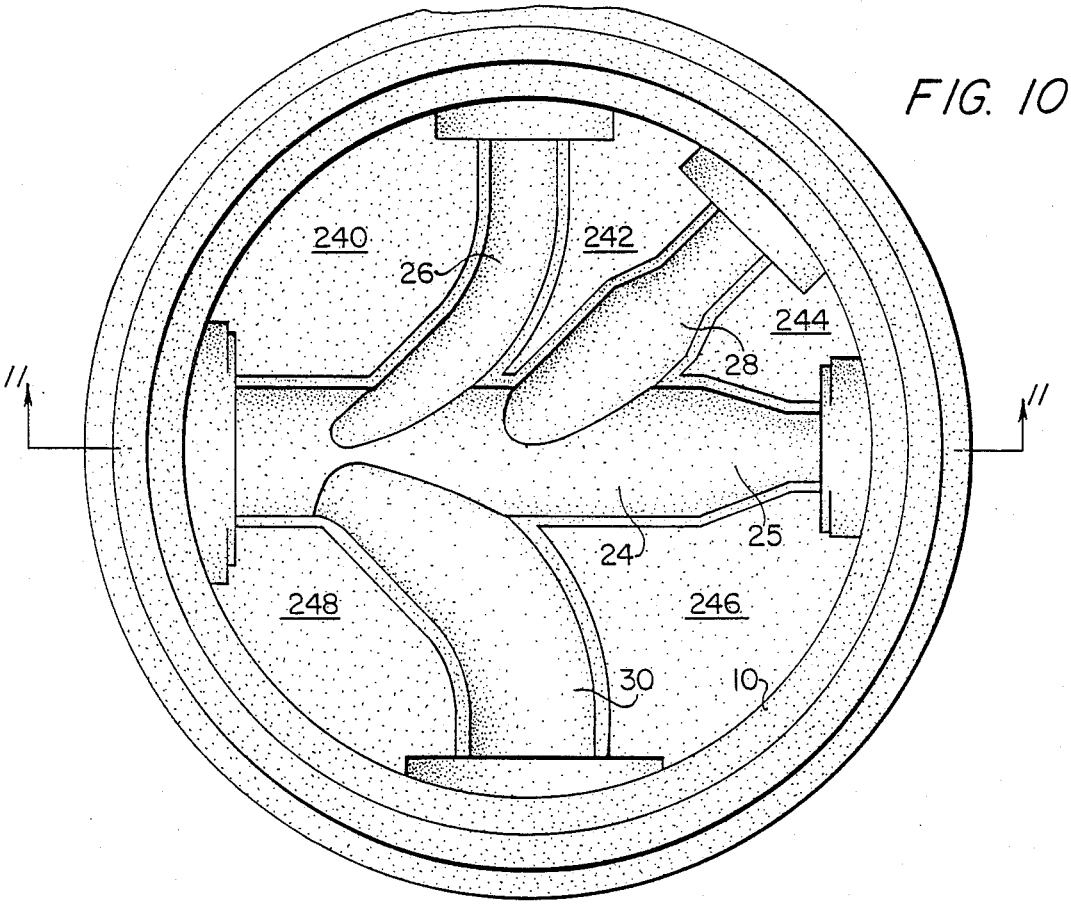
FIG. 10 is a top plan view of a manhole showing the inverts formed by use of the system illustrated in FIG. 1.

The preferred embodiment of the present invention is used in a double-pour operation in conjunction with a previously poured partially completed manhole comprising a vertically extending cylindrical side wall 10 having a base or floor portion 12 as that shown in FIG. 2. Openings 14, 16, 18, 20 and 22 are provided in the side wall 10 for connection to pipes which are to be connected to the manhole as part of the field installation. An understanding of the purpose and intent of the invention will be better achieved with reference to the finished manhole illustrated in FIG. 10 which includes a main outflow invert channel 24 extending between a larger opening 14 and a smaller opening 18 in the side wall 10, an inflow invert channel 26 which extends inwardly from the opening 22 in wall 10 and is joined at its outer end to the main outflow channel 24, and an inflow invert channel 28 extending inwardly from opening 20 in the side wall 10 and which is joined at its outer end to the main outflow invert channel 24. Also, a third inflow invert channel 30 extends inwardly from the opening 16 and is joined at its outer end to the main outflow invert channel 24. It should be understood that use of the invention is not limited to an installation of the type shown in FIG. 1 etc. which is merely a typical installation. In actuality the invention can be employed for forming literally thousands of different manhole invert configurations having varying characteristics such as number, size and location of inverts. The structure employed for forming the main outflow invert channel 24 will be initially discussed with the reference being made to FIGS. 1, 2, 4, 5 and 6. More specifically, mounting hardware for attachment of the mold members to the wall 10 of the manhole in the areas adjacent openings 14 and 18 comprises external bars 32 extending diametrically across the outer ends of openings 14 and 18 and each of which is provided with a central aperture 34 through which a threaded rod 36 extends. A nut 38 is provided on the outer end of each the threaded rod 36 and an internal frame 40 aligned with opening 14 and is contoured to engage the inner surface 11 of the side wall as shown in FIG. 6 which is connected to the inner end of the threaded rod. An identical, but smaller internal frame 40' is fitted over the inner end of smaller opening 18. Internal frames 40 includes an upper horizontal component 42, vertical side components 44, 46 and a lower arcuate component 48. Additionally, internal frame 40 also includes a transverse bar 50 extending between the lower ends of the vertical side components 44 and 46 and which has a threaded opening in which threaded rod 36 is threadably received. First and second clamp plates 52 and 54 are respectively bolted to the side components 44 and 46 by adjustable threaded bolt members 56 and 58. Internal frame 40' includes equivalent, but smaller, components. An end support face plate 62 is held in position on the internal frame 40 by the clamping action of first and second clamp plates 52 and 54 as best shown in FIGS. 4 and 5.

A threaded centering and alignment disk 60 is threadably received on the inner end of the threaded rod 36 and serves to maintain an end piece invert mold member 66 in proper alignment with opening 14. The end support face plate 62 is provided with an opening 64 for matingly receiving the end piece invert mold member 66 in the position shown. End slots 68 of end piece invert mold member 66 fit over the transverse bar 50 of the internal frame member 40. The end piece invert mold member 66 is unitarily formed of polyurethane such as sold under the trademark VIBRATHANE B-640 by Uniroyal Chemical of Naugatuck, Conn., which is a very tough almost unbreakable material which is chemically unaffected by concrete ingredients, chemical or otherwise. The other invert mold members discussed herein are also formed of the same material.

Figure 4:
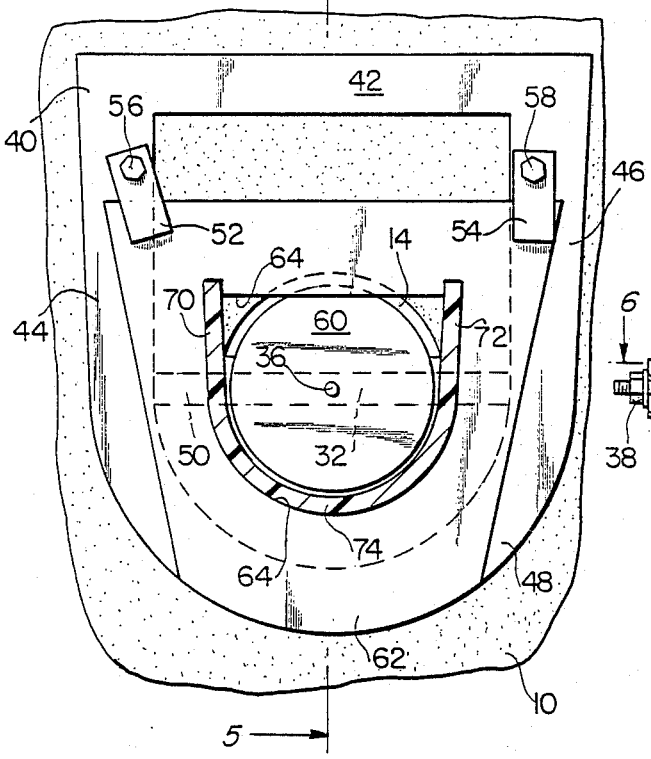
FIG. 4 is a sectional view taken along lines 4—4 of FIG. 2.

The end piece 66 additionally comprises a lengthwise extending U-shaped trough 69 which is symmetrical relative to its longitudinal axis A and comprises linear side portions 70 and 72 joined at their lower ends by an arcuate bottom portion 74 as best shown in FIG. 4. End piece invert mold member 66 additionally includes an end wall 76 which is unitarily formed with the lengthwise extending U-shaped trough member 69 and which is perpendicular to the longitudinal axis A of the trough assembly. A circular opening 78 is provided in the end wall 76 as are four bolt receiving openings 80 for receiving threaded bolts of a bolt and nut assembly 82.

An elongated linear invert mold member 86 is connected to end piece invert mold member 66 by bolt and nut members 82 which extend through openings 88 (FIG. 3) in end wall 90 of the elongated invert mold member 86. The openings 88 are aligned with openings 80 in end wall 76 and end wall 90 is of identical size and configuration to end wall 76 of end piece invert mold member 66. The elongated linear invert mold member 86 additionally includes a lengthwise extending U-shaped trough portion 92, which is identical in cross-section to the U-shaped trough portion 69 of end piece 66, and a second end wall 90 which is identical to the first-mentioned end wall 90. It should be observed that the end walls 90 are provided with circular openings 91. A second elongated linear invert mold member 86' of identical construction to member 86 is connected to the above-discussed first elongated linear invert mold member and it should be observed from inspection of FIG. 8 that the elongated linear invert mold members 86 and 86' each include a transverse medial brace plate 94 extending unitarily inward from the lengthwise extending U-shaped trough member 92 at a location midway between end walls 90. Each of the medial brace plates 94 is provided with a U-shaped slot comprising side edges 96 and 97 and a bottom edge 98. The U-shaped slot is symmetrical with respect to the longitudinal mid-plane of the elongated linear invert mold members 86.

Figure 3:
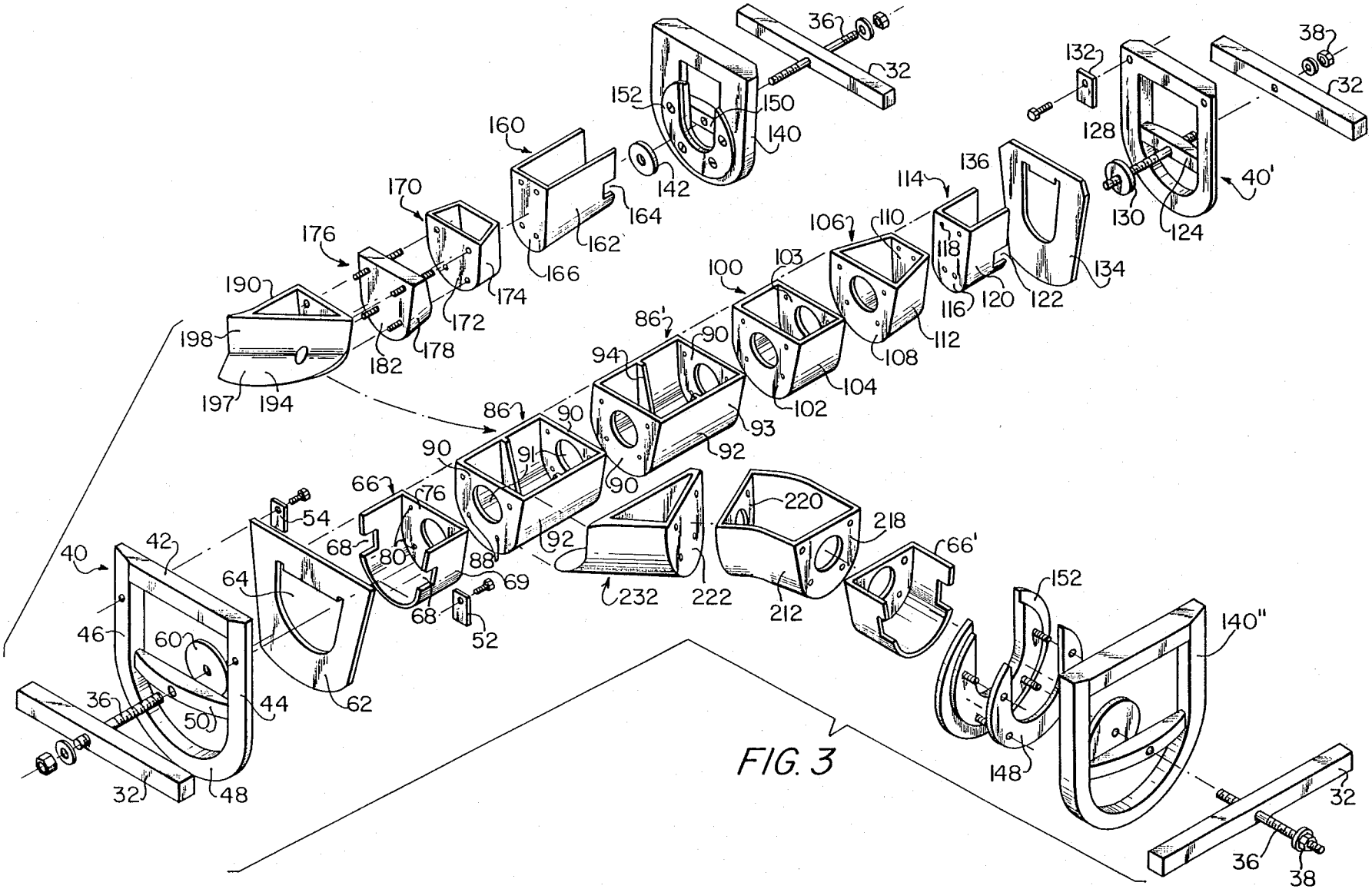
FIG. 3 is an exploded perspective view illustrating various components of the embodiment of FIG. 1.

A relatively short linear invert mold member 100 is connected to the right end of elongated invert mold member 86' as viewed in FIGS. 1 and 3 and includes end walls 102 and 103 which are identical to end walls 90 of the elongated linear invert mold members 86 and 86' and which end walls are joined by a U-shaped lengthwise extending trough 104. Thus, it will be apparent that relatively short linear invert mold member 100 is identical to members 86 and 86' with exception of the fact that it is shorter and does not have a medial brace plate.

A tapered or reducer invert mold member 106 is connected to the relatively short linear invert mold member 100 by bolt and nut means 101 extending through apertures in an end wall 108 that is identical to end walls 76, 90, 102 and 103. The opposite end of reducer invert mold member 106 is defined by a smaller end wall 110. End walls 108 and 110 are connected by a tapered U-shaped trough component 112 which tapers inwardly symmetrically relative to the longitudinal vertical axial plane of member 106. End walls 108 and 110 are provided with bolt receiving openings 111 which receive bolt and nut assemblies for connecting wall 110 of mold member 106 to a reduced size end piece 114 and wall 108 to wall 103.

Reduced size end piece 114 has a single end wall 116 provided with bolt receiving openings 118 alignable with the openings in small end wall 110 of the tapered invert mold member 106. A lengthwise extending U-shaped trough member 120 extends unitarily from end wall 116 and includes a pair of slots 122 dimensioned and shaped to loosely fit over a transverse bar 124 of the internal frame member 40' positioned against the inner surface of side wall 10 surrounding opening 18 provided in the side wall.

The internal frame member 40' is structurally identical to internal frame 40 but is of smaller size due to the fact that the opening 18 with which it is associated is smaller than the opening 14 with which internal frame 40 is associated. Additionally, it should be noted that internal frame 40' is also associated with a threaded rod 128 on which an alignment disk 130 is threadably mounted. Rod 128 is also threaded into a threaded opening in transverse bar 124 and has a nut 38 on its outer end for engaging bar 32 extending across opening 18 externally of wall 10. A pair of clamp plates 132 (only one of which is illustrated in FIG. 3) are mounted for clamping an end support face plate 134 in position on internal frame 40' in the same manner that end support face plate 62 is clamped to the internal frame 40. Additionally, the end support face late 134 includes an opening 136 that is dimensioned and shaped to matingly receive the end of the U-shaped trough member 120 for supporting same.

Figure 11:
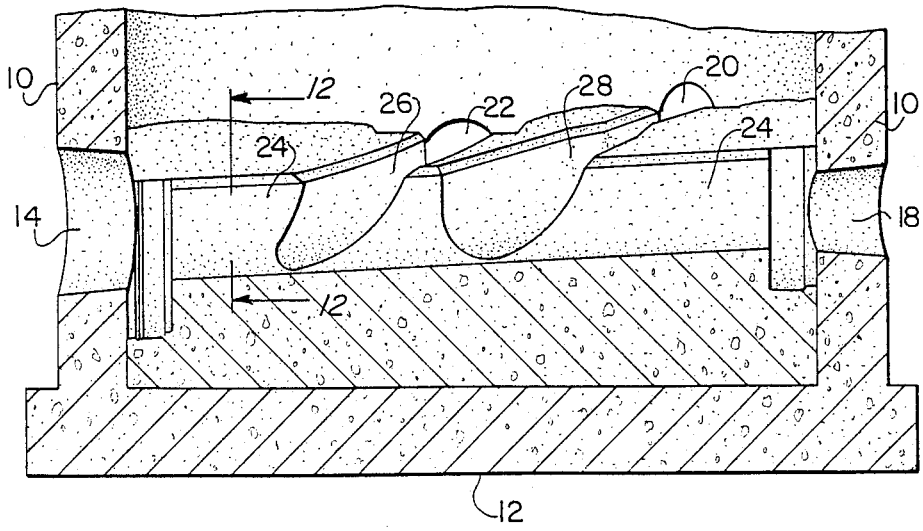
FIG. 11 is a sectional view taken along lines 11—11 of FIG. 10.

All of the above-described component parts operate to form the main outflow invert channel 24 illustrated in FIG. 11 with the tapered portion 25 of the main outflow invert channel being formed by the tapered or reducer invert mold member 106. It should be understood that the system is quite flexible and that if the opening 18 in the wall was of the same size as the opening 14, the entire outflow invert channel would be of the same width across its entire length by using a member of the same shape as members 86 or 100 in place of the tapered reducer invert mold member 106.

In the installation illustrated in FIGS. 1 etc. the system is set up to provide an invert channel from openings 20, 22, and 16 in the side wall 10 to the main outflow channel. Invert channel 26 flows from opening 22, invert channel 28 flows from opening 20 and invert channel 30 flows from opening 16. The mounting bracket and attachment means connected to the openings 20, 22 and 16 are identical to each other with the exception of the fact that the means associated with opening 16 is larger than those associated with openings 20 and 22. However the bracket assemblies for openings 16, 20 and 22 are substantially different from those connected to openings 14 and 18 in that they (i.e. those mounted over openings 16, 20 and 22) permit a pivotal rotational positioning of the end piece invert mold members generally about an axis coextensive with the axis of their associated side wall opening.

The pivotal mounting means employed with openings 16, 20 and 22 will now be discussed specifically with respect to the means associated with opening 20 which comprises an external bar or channel member 32 associated with a threaded rod 36 extending through the member 32 in the manner previously discussed with respect to the apparatus associated with openings 14 and 18. A swivel support bracket frame 140 is provided on the interior surface of wall 10 and includes a transverse bar 150 in which the threaded rod 36 is threadably mounted. A threaded alignment disk 142 is mounted on the threaded rod 36. When nut means 38 on the end of threaded rod 36 is tightened, bar 150 is pulled outwardly to forcefully clamp the swivel support bracket frame 140 against the inner surface of wall 10 as best shown in FIGS. 8 and 9.

Figure 8:
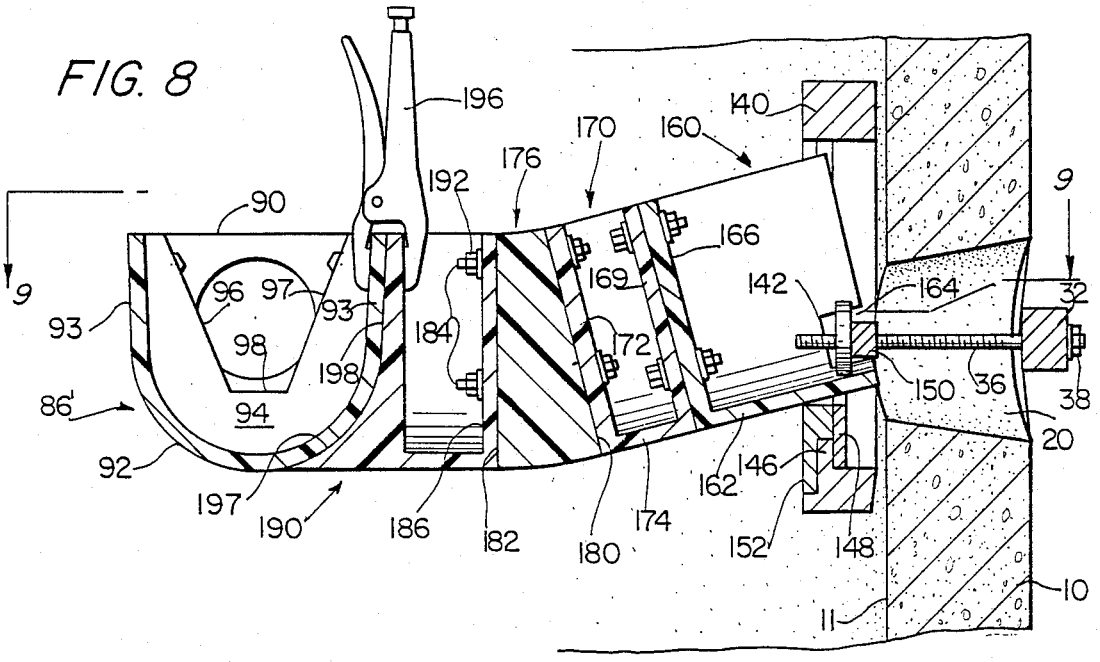
FIG. 8 is a sectional view taken along lines 8—8 of FIG. 1.
Figure 9:
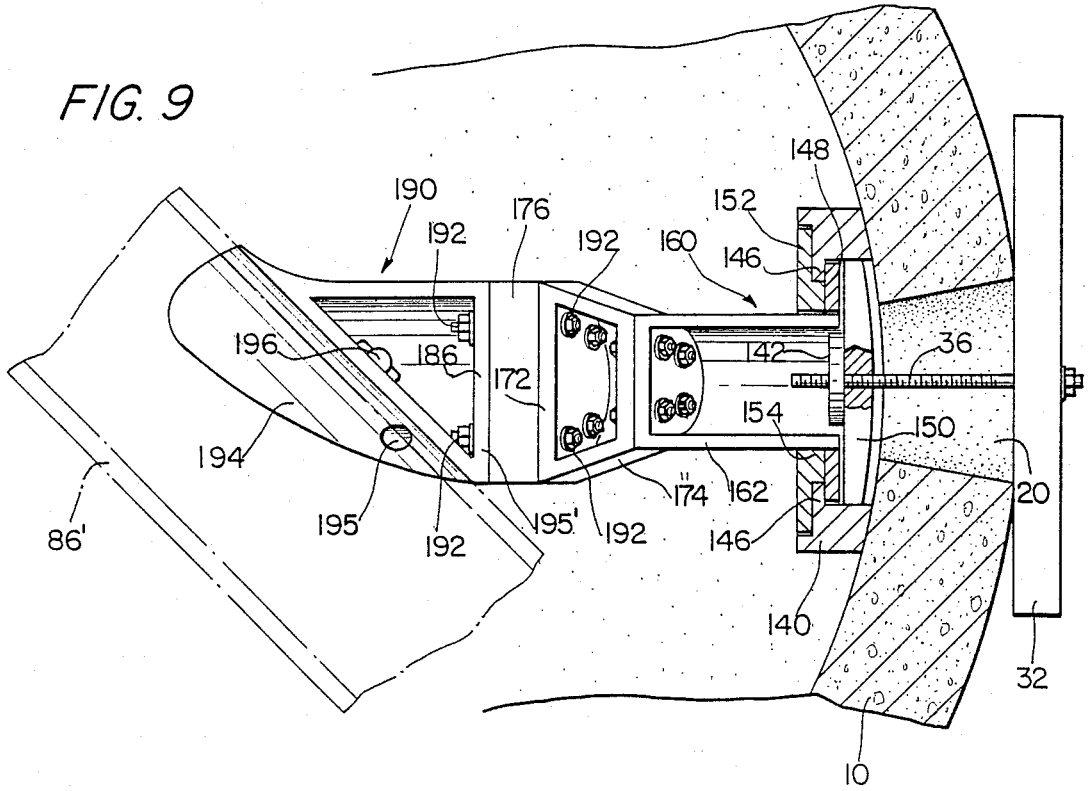
FIG. 9 is sectional view taken along lines 9—9 of FIG. 8.

A radially inwardly extending flange 146 is provided in the swivel support bracket frame 140 with a rotary retainer plate 148 being positioned between the inwardly extending flange 146 and the transverse bar 150 as best shown in FIG. 9. A second rotary retainer plate 152 fits over flange 146 and is connected to the inner rotary retainer plate 148 by threaded bolt members or machine screws 154. Members 148 and 152 consequently constitute a unitary rotary plate which serves the same purpose as end support face plates 62 and 134. Plate 148, 152 is held in position for rotation about its axis by flange 146. Additionally, members 148 and 152 each have U-shaped slots which are aligned with each other and matingly receive the inner end of the U-shaped trough 162 of an end piece mold member 160. The U-shaped lengthwise extending trough portion 162 has slots 164 on its forward end which loosely fit over the transverse bar 150. A transverse end wall 166 defines the outer end of end piece mold member 160 as best shown in FIGS. 3 and 8. Wall 166 is provided with a plurality of apertures for receiving bolt and nut members which rigidly connect the mold member 160 to an end wall 169 of a tapered or reducer invert mold member 170 having an opposite end wall 172. A flared U-shaped trough portion 174 connects walls 169 and 172. Wall 172 is connected to an elevator section block 176.

Elevator section block 176 is formed of solid polyurethane of the same type as used for the other mold members and has a U-shaped outer surface 178 and end surfaces 180 and 182 which are located in planes which intersect on a line perpendicular to the plane of the paper in FIG. 14A so that end walls 180 and 182 are canted relative to each other as best shown in FIG. 14-A. Additionally, a plurality of threaded studs 184 extend outwardly from end walls 180 and 182 in alignment respectively with apertures in wall 172 of member 170 and apertures 195' in wall 186 of a merge juncture forming slider mold block 190. Nut members 192 are threadedly received on the studs 184 for clamping the components together in an obvious manner.

Merge juncture forming slider block 190 is provided with a canted end surface 194 which matingly engages the outer surface of the elongated linear invert mold member 86' as best shown in FIGS. 8, 9 and 16. It should be appreciated from inspection of FIG. 8 that the surface 194 comprises a lower cylindrical surface 197 which matingly engages the cylindrical curved surface defining the lower portion of elongated linear invert mold member 86' and an upper flat or planar portion 198 which engages one of the planar portion 93 of the U-shaped member 92 as best shown in FIG. 8. One or more clamp members 196 serve to clamp the slider mold block surface 197 and 198 into intimate contact with the outer surface of the elongated linear invert mold member 86'. An aperture 195 in canted end surface 194 is provided in alignment with an opening 195' in end wall 186 to provide access by a socket wrench or the like to a connector nut 192 on one of studs 184.

Figure 7:
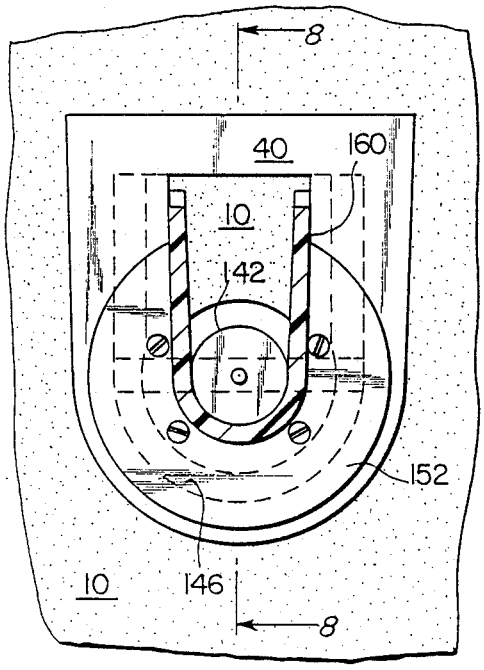
FIG. 7 is a sectional view taken along lines 7—7 of FIG. 1.

Thus, it should be seen that the mold components illustrated in FIGS. 7, 8 and 9 serve to provide for an inflow invert channel 28 comprising a canted portion extending downwardly from relatively small opening 20 (as shown in FIG. 8) and a horizontal portion intersecting the main outflow invert channel 24. Thus, a smooth and continuous flow channel from an inlet pipe having a smaller diameter than the diameter of the main outflow invert channel 24 is provided.

The invert molding means employed to connect relatively small opening 22 with the main outflow invert channel 24 is similar to that employed in conjunction with opening 20; however, it is not necessary to use a riser or elevator section analogous to means 176 since the opening 22 is at a lower elevation than the opening 20 and the inflow invert channel 26 needs to have only a slight canting downwardly from opening 20 with respect to the horizontal in order to perform its function. The means employed for connecting opening 22 to the main outflow invert channel 24 comprises a swivel support bracket frame 140' and associated retainer plate means 148, 150, etc. identical to the means employed in connection with opening 20. A U-shaped end piece mold member 160' is received in the swivel support bracket frame 140' in the same manner that member 160 is received in the swivel support bracket frame 140. End piece mold member 160' is bolted to a curved invert mold member 200 which curves in a horizontal manner about a vertical center of curvature and has end plates 202, 204 each oriented in vertical planes that are oriented approximately 45 degrees with respect to each other and which are connected by a U-shaped trough member 206. A slider mold block 208 having a mating surface 210 similar to surfaces 197, 198 is configured to flatly engage the outer surface of elongated linear invert mold member 86 and is bolted to end plate 204 in an obvious manner. Clamp means 196 holds slider block 206 in snug relationship to mold member 86.

Opening 16 in wall 10 is relatively large and the inflow invert channel 30 extending from opening 16 to the main outflow invert channel 24 is consequently of larger size than any of the other inflow invert channels. The mounting hardware employed in connection with opening 16 is essentially a larger version of that employed with openings 20 and 22 and includes a swivel support bracket frame 140'' identical in function to brackets 140 and 140' in which rotary retainer plate members identical in function to 148, 150 are mounted for supporting an end piece invert mold member 66' essentially identical to member 66. End piece invert mold member 66' is bolted to a horizontally curved invert mold member 210 having a trough portion 212 consisting of a cylindrical lower portion 214 and upper planar portions 216 as shown in FIG. 2 with the trough portion 212 having end walls 218 and 220. End wall 218 is bolted to an end wall 76' of end piece invert mold member 66' and end wall 220 is bolted to an end wall 222 of a merge juncture forming slider mold block 230 having a mating surface 232 similar to surface 197, 198 engaged with the outer surface of the elongated linear invert mold member 86'. Clamp members 196 are likewise employed for clamping slider 230 to member 86.

Figure 12:
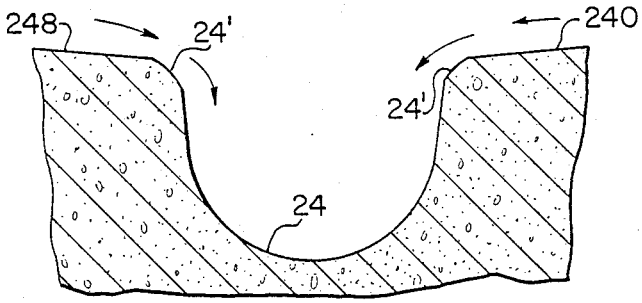
FIG. 12 is a transverse sectional view taken along lines 12—12 of FIG. 11.

After the various mold components are bolted and clamped together in the array shown in FIG. 1, a rugged and strong assembly not requiring any external bracing is resultant. Concrete is poured on to the base of floor portion 12 of the manhole and is filled upwardly to a level closely adjacent the upper edge of the lowest mold member (which would be the upper edge of member 66 as shown in FIG. 2). The concrete is vibrated to fill all voids and additional concrete is subsequently provided by hand and benched upwardly to wall 10. Inclined surfaces 240, 242, 244, 246, and 248 which slope downwardly toward the invert mold members forming the main outflow invert channel and also slope toward the mold members forming the inflow invert channels 26, 28 and 30 are provided in order to insure that any sewage or other liquid material on the surfaces will flow into the main outflow invert channel for discharge outwardly through opening 14. Also, the inverts are beveled along their upper edges as shown at 24' in FIG. 12.

Bolt and nut assemblies are passed through the apertures in the end walls of the mold members for effecting a strong clamping-like junction between the tapered or reducer invert mold members and an adjacent mold member. It should be understood that all of the mold members are of the same vertical height from the bottom of their trough portions to the top of the mold member. However, the mold members come in varying widths in order to provide channels of varying widths. Also, the linear mold members, such as members 86 and 100, come in varying lengths. The curved mold members, such as mold members 210, also come in various widths and various degrees of curvature. For example, FIG. 17 illustrates a composite linear-curved mold section 244, comprising a centrally located curved distortion 246 and two linear end portions 248, which terminate in end walls 250. A trough 252 of U-shaped cross section extends the length of the linear-curved mold member 244 as shown in FIG. 17. A plurality of similar mold members having the same length along their center lines are provided with different degrees of curvature and different linear length portions. For example, a version having a 37½ degree accurate center portion 246 would have linear end sections that are substantially shorter that those shown in the embodiment of FIG. 17. Additionally, it has been found convenient to provide a small number of curved mold members in which the curved portion is associated with only one linear end portion, so that one of the end walls would be provided adjacent the end extend of one side of the curved center portion, whereas the sole linear portion would extend outwardly from the other end of the curved center portion.

FIG. 15 illustrates a Y-shaped mold member 260, employed for defining the juncture between two smaller inflow channels with a larger outflow channel. More specifically, the smaller inflow channels are formed by mold portions 262 and 264 which are arcuately curved and meld into a larger outflow channel forming portion 266 having an end wall 268. The smaller channels 262 and 264 respectively have end walls 270 and 272, with all of the end walls being provided with apertures for receiving connector bolts as discussed previously. Members 262, 264 and 266 are U-shaped in cross section.

Another feature of the invention resides in the fact that the end piece invert mold members 66, 160, etc. are provided in a variety of lengths and can be cut to a desired length necessary to properly fit in their associated mounting brackets, etc. Moreover, the slots 68, 164, etc. are of sufficient width and height as to permit the end pieces to be mounted in the supporting brackets with a substantial amount of play. It is consequently not necessary that the remaining mold portions extending between the end pieces have a precise mathematical length or a precise orientation due to the relatively loose manner in which the end pieces can be received in either a mounting frame such as frame 40, or the swivel type arrangement associated with frames 140 and 140'.

Assembly of the system begins with the mounting of the brackets 40, 140, etc. in the manhole opening for the particular installation. The mold sections for any straight-through channel are determined and bolted together initially. There is a substantial amount of flexibility in the overall length of the bolted-together mold components which will result in a satisfactory formation of an invert due to the fact that the end sections 66 must only be of sufficient length that their U-shaped portions 70, 72, 74 (in the case of member 66), must be received within the confines of the mating opening in the end support face plate 62 or the rotary plate 148, 152. For example, the end piece 66 illustrated in FIG. 5 could be considerably shorter than actually shown and still provide a satisfactory result. Consequently, the overall length of the mold members that are bolted together is not critical and since the linear mold members and the curved mold members are provided in a variety of lengths (and angles in the curved molds), a satisfactory assembly can be easily provided. The curved mold members are provided with angles of 7½°, 15°, 22½°, 30°, 37½° and 45°. Similarly, the elevator sections such as 176 have end walls canted at 7½°, 15° and 22½° angles. All of the walls and troughs of the mold members are preferably of a thickness of 0.375 inches; however, thicker walls and trough portions of approximately 0.5625 inches thickness have also been used.

The U-shaped trough members preferably include a semi-cylindrical lower portion having an angular extent of approximately 180° and upper planar panel portions which are inclined outwardly in an upward direction of at least approximately 2° from the vertical.

After the straight through main invert channel forms have been assembled and positioned, any other incoming channel forming invert molds are bolted together and connected to the main mold members by use of merge juncture sliders such as members 190, 208, etc. Here again, the system is sufficiently flexible that the mold members forming the inflow channels need not be of a mathematically precise length, due to the flexibility of the connection of the slider to the main outflow invert forming mold assembly and the connection of the end pieces to the swivel support bracket frames 140, 140' etc. Additionally, it should be understood that the swivel support bracket frames 140, 140' and 140''' permit the inflow invert channel forming mold members associated therewith to be pivoted about the axis of the opening with which the bracket members are associated so as to provide the proper canting and elevation to provide a satisfactory inflow invert from the particular wall opening of the manhole to the main outflow invert channel, such as channel 24 in FIG. 1.

The outer sections of the mold members are coated with a conventional release material so that the mold members can be separated from the concrete after it is poured. Following pouring of the concrete, the upper surface is benched to desired elevations by hand trowelling and finished with a smooth trowel or a light broom finish. After the concrete sets, the invert molding system is removed to complete the manhole construction.

Therefore, it will be apparent that the present invention permits a rapid and accurate formation of invert channels in a manhole base with total flexibility so that practically any channel construction can be fabricated in a minimum of time without the need for highly skilled labor. The construction is remarkably rugged and durable and has great strength far in excess of that necessary to resist the buoyancy of the liquid concrete which pushes upwardly on the rigid system until the concrete has set. Consequently no additional bracing of the mold assembly is required.

While the disclosed embodiments represent preferred representative approaches, the system is totally flexible and the mold components can be arranged in countless ways depending upon the particular location of the inflow and outflow openings of the manhole being formed. Thus, the spirit and scope of the invention is not to be limited solely by the appended claims.

What is claimed is:

1. An invert forming system for forming custom inverts in a partially completed manhole formed of a cylindrical wall having a vertical axis and a plurality of pipe openings, and a base or floor portion closing a lower end of said manhole, said system comprising:

an elongated mold member free of supplemental bracing for holding said member in position during invert formation, said member having a generally U-shaped outer surface extending in bridge-like manner between two of said pipe openings;

support means adjacent to each of said two pipe openings each comprising an internal frame dimensioned to snugly engage an inner surface of said cylindrical wall, an opening in said frame being dimensioned to surround one of said pipe openings in said cylindrical wall, retaining means for clamping said internal frame in a fixed position on said cylindrical wall with said pipe opening being surrounded by said opening in said frame; and plate means attached to said internal frame for supporting one end of said elongated mold member, said plate means including a central opening configured to matingly receive one end of said elongated mold member.

2. An invert forming system as recited in claim 1 additionally including rotary bearing means on said internal frame for supporting said plate means for rotation about an axis approximately parallel to an axis of the pipe opening with which the internal frame is associated.

3. An invert forming system for forming custom inverts in a partially completed manhole including a cylindrical wall having a vertical axis and a plurality of pipe openings, and a base or floor portion closing a lower end of said manhole, said system comprising:

a plurality of hollow connectable mold members free of supplemental bracing for holding said members in position during invert formation, each of said members being formed of polyurethane and having at least one end wall means extending transversely to a lengthwise axis of the invert to be formed and a U-shaped trough member unitarily formed with said end wall means and extending from said end wall means in a direction lengthwise of the invert to be formed;

said end wall means and said U-shaped trough members having a wall thickness of at least approximately 0.375 inches;

said end wall means having an upper linear edge portion adjacent upper linear edge portions of said U-shaped trough member and extending transversely across a substantial width of the mold member;

connector means for clamping adjacent ones of said end wall means of a plurality of said mold members together to provide a rigid self-sustaining invert mold capable of extending in a bridge-like manner between two of said pipe openings;

said U-shaped trough members comprising a semicylindrical lower portion having an angular extent of approximately 180° and upper planar panel portions which are inclined outwardly in an upward direction of at least approximately 2° from a vertical plane;

at least one of said mold members having plural parallel end wall means defining opposite ends of a lengthwise linear extending mold member;

at least one of said linear extending mold members additionally including a medial brace plate extending transversely of the mold member from opposite sides of the U-shaped trough approximately midway between said end wall means;

said plurality of hollow connectable mold member including a reducer invert mold member having a pair of end wall means, one of said end wall means thereof is of less width than the other of said pair of end wall means; and said mold members including end piece invert mold members each having only a single end wall with the opposite end of each of said end piece mold members comprising an open transverse end of the U-shaped trough of said mold members and further including first and second mounting slots respectively extending inwardly from first and second sides of said open transverse end and dimensioned to fit over a portion of an invert mold support means mounted in one of said pipe openings in the cylindrical wall of said manhole.

4. The system of claim 3 wherein said support means comprises an internal frame dimensioned to snugly engage an inner surface of said cylindrical wall of said manhole, an opening in said frame being dimensioned to surround a pipe opening in said cylindrical wall, retaining means for clamping said internal frame in a fixed position on said cylindrical wall with said pipe opening being surrounded by said opening in said frame, and a transverse bar extending across said opening in said frame and having a vertical dimension less than a vertical dimension of said mounting slots of said end piece mold members.

5. An invert forming system as recited in claim 4 wherein said retaining means additionally includes an external bar positioned externally of a pipe opening to span said pipe opening, an opening in said external bar, a threaded rod extending through said external bar opening, a threaded opening in said transverse bar with said threaded rod being threaded therein, and rotary means on said threaded rod for drawing said external bar and said transverse bar toward each other to clamp said internal frame to the inner surface of the manhole cylindrical wall.

6. An invert forming system as recited in claim 5 wherein said plurality of hollow connectable mold members include at least one merge juncture mold member, said merge juncture mold member having a single end wall means and an opposite compound end wall surface consisting of a lower cylindrical surface portion and an upper planar surface which together conform to an outer surface of one of said lengthwise extending linear mold members so that said compound surface of said merge juncture mold member can be clamped to the outer surface of a lengthwise linear extending mold member to permit the molding of a smooth juncture between an inflow invert channel, an inner end of which is formed by said merge juncture mold member, and a main outflow channel, a portion of which is formed by said lengthwise linear extending mold member.

7. An invert forming system as recited in claim 5 additionally including an end support face plate attached to an inner surface of said internal frame, an opening in said end support face plate dimensioned and configured to matingly receive and support said open transverse end of one of said end piece invert mold members.

8. The invert forming system as recited in claim 7 additionally including alignment disk means mounted on said threaded rod for engaging, aligning and positioning said end piece invert mold member.

9. An invert forming system as recited in claim 4 additionally including rotary bearing means on said internal frame, disk means mounted on said rotary bearing means for rotation about an axis substantially parallel to a lengthwise axis of one of said end piece mold members, an opening in said disk means dimensioned and configured to matingly receive and support said open transverse end of one of said end piece mold members.

10. An invert forming system as recited in claim 9 wherein said retaining means additionally includes an external bar positioned externally of a pipe opening to span said pipe opening, an opening in said external bar, a threaded rod extending through said external bar opening, a threaded opening in said transverse bar with said threaded rod being threaded therein and rotary means on said threaded rod for drawing said external bar and said transverse bar toward each other to clamp said internal frame to the inner surface of the manhole cylindrical wall.

11. An invert forming system as recited in claim 3 wherein said plurality of hollow connectable mold members includes at least one invert mold member having a horizontally curved U-shaped trough member extending between a pair of said end wall means oriented in non-parallel vertical planes.

12. An invert forming system as recited in claim 11 additionally including riser or elevator section mold means having first and second end surfaces of the same size and shape as the end wall means of said hollow connectable mold members, said first and second end surfaces lying in planes which intersect along a horizontal line above said riser or elevator section mold means and threaded stud means extending perpendicularly outward from said first and second end surfaces and wherein said end wall means of said hollow connectable mold members include apertures positioned to be alignable with said threaded stud means and nut means positioned on said threaded stud means for effecting the clamping of said riser or elevator section mold means to said hollow connectable mold members.

13. An invert forming system for forming custom inverts in a partially completed manhole including a cylindrical wall having a vertical axis and a plurality of pipe openings, and a base or floor portion closing a lower end of said manhole, said system comprising:

a plurality of hollow connectable mold members free of supplemental bracing for holding said members in position during invert formation, each of said members having at least one end wall means extending transversely to a lengthwise axis of the invert to be formed and a U-shaped trough member unitarily formed with said end wall means and extending from said end wall means in a direction lengthwise of the invert to be formed;

connector means for clamping adjacent ones of said end wall means of a plurality of said mold members together to provide a rigid self-sustaining invert mold capable of extending in a bridge-like manner between two of said pipe openings;

said end wall means having an upper linear edge portion adjacent upper linear edge portions of said U-shaped trough member and extending transversely across a substantial width of the mold member;

wherein said U-shaped trough members comprise a semi-cylindrical lower portion having an angular extent of approximately 180° and upper planar panel portions which are inclined outwardly in an upward direction of at least approximately 2° from a vertical plane;

at least one said hollow connectable mold members having plural parallel end wall means defining opposite ends of a lengthwise linear extending mold member;

said plurality of hollow connectable mold members including a reducer invert mold member having a pair of end wall means, one of said end wall means thereof is of less width than the other of said pair of end wall means; and said plurality of hollow connectable mold members including end piece invert mold members having only a single end wall means with the opposite end of said end piece mold members comprising an open transverse end of the U-shaped trough of said mold members and further including first and second mounting slots respectively extending inwardly from first and second sides of said open transverse end and dimensioned to fit over a portion of an invert mold support means mounted in one of said pipe openings in the cylindrical wall of said manhole.

14. The system of claim 13 wherein said support means comprises an internal frame dimensioned to snugly engage an inner surface of said cylindrical wall of said manhole, an opening in said frame being dimensioned to surround said pipe opening in said cylindrical wall, retaining means for clamping said internal frame in a fixed position on said cylindrical wall with said pipe opening being surrounded by said opening in said frame, and a transverse bar extending across said opening in said frame and having a vertical dimension less than a vertical dimension of said mounting slots of said end piece mold members.

15. An invert forming system as recited in claim 14 wherein said retaining means additionally includes an external bar positioned externally of a pipe opening to span said pipe opening, an opening in said external bar, a threaded rod extending through said external bar opening, a threaded opening in said transverse bar with said threaded rod being threaded therein, and rotary means on said threaded rod for drawing said external bar and said transverse bar toward each other to clamp said internal frame to the inner surface of the manhole cylindrical wall.

16. An invert forming system as recited in claim 15 additionally including an end support face plate attached to an inner surface of said internal frame, an opening in said end support face plate dimensioned and configured to matingly receive and support said open transverse end of one of said end piece invert mold members.

17. An invert forming system as recited in claim 14 additionally including rotary bearing means on said internal frame, disk means mounted on said rotary bearing means for rotation about an axis substantially parallel to a lengthwise axis of one of said end piece mold members, an opening in said disk means dimensioned and configured to matingly receive and support said open transverse end of one of said end piece mold members.

18. An invert forming system as recited in claim 17 wherein said retaining means additionally includes an external bar positioned externally of a pipe opening to span said pipe opening, an opening in said external bar, a threaded rod extending through said external bar opening, a threaded opening in said transverse bar with said threaded rod being threaded therein and rotary means on said threaded rod for drawing said external bar and said transverse bar toward each other to clamp said internal frame to the inner surface of the manhole cylindrical wall.

19. An invert forming system for forming inverts in a partially completed manhole having a vertical cylindrical wall, a plurality of pipe openings in the cylindrical wall, and a floor pattern in a lower end of said manhole, said system comprising:

a plurality of hollow connectable polyurethane mold members free of supplemental bracing for holding said members in position during invert formation, said members arranged in an end-to-end aligned array and each including end wall means extending transversely to a lengthwise axis of the invert to be formed, and a lengthwise extending U-shaped trough member having first and second ends, said end wall means extending transversely of the U-shaped trough adjacent at least one end of said U-shaped trough member;

said end wall means each having a plurality of apertures and an upper linear edge portion adjacent upper linear edge portions of said U-shaped trough member and extending transversely across a substantial width of the mold member; and bolt means extending through aligned apertures in end wall means of adjacent mold members for clamping adjacent ones of said end wall means of a plurality of said mold members together to provide a rigid self-sustaining invert mold extending in a bridge-like manner between two of said pipe openings;

said end wall means and said U-shaped trough members having a wall thickness of at least approximately 0.375 inches;

said U-shaped trough members comprising a semicylindrical lower portion having an angular extent of approximately 180° and upper planar panel portions which are inclined outwardly in an upward direction of at least approximately 2° from a vertical plane;

at least one of said hollow connectable mold members having plural parallel end wall means defining opposite ends of a lengthwise extending linear mold member;

said plurality of hollow connectable mold members including a reducer invert mold member having a pair of end wall means one of said end wall means thereof is of less width than the other of said pair of end wall means;

said mold members additionally including end piece invert mold members having only a single end wall means with the opposite end of said end piece mold members comprising an open transverse end of the U-shaped trough of said end piece mold members;

and additionally including means for engaging said end piece mold members to invert mold support means mountable to the cylindrical wall at said pipe openings, and wherein said support means comprises an internal frame dimensioned to snugly engage an inner surface of said cylindrical manhole wall, an opening in said frame dimensioned to surround a pipe opening in said cylindrical wall, and retaining means for clamping said internal frame in a fixed position on said cylindrical wall with said pipe opening being surrounded by said opening in said frame.

20. An invert forming system as recited in claim 19 wherein said plurality of hollow connectable mold members includes at least one merge juncture mold member, said merge juncture mold member having a single end wall means and an opposite compound end wall surface consisting of a lower cylindrical surface portion and an upper planar surface which together conform to an outer surface of one of said lengthwise extending linear mold members so that said compound surface of said merge juncture mold members can be clamped to an outer surface of a lengthwise linear extending said mold member to permit the molding of a smooth juncture between an inflow invert channel, an inner end of which is formed by said merge juncture mold member, and a main outlfow channel, and another portion of which is formed by said lengthwise linear extending mold member.

21. An invert forming system as recited in claim 19 additionally including an end support face plate attached to an inner surface of at least one of said internal frames, an opening in said end support face plate dimensioned and configured to matingly receive and support said open transverse end of one of said end piece invert mold members.

22. In invert forming system as recited in claim 19 additionally including rotary plate means on at least one of said internal frames, rotary plate means mounted on said rotary bearing means for rotation about an axis substantially parallel to a lengthwise axis of one of said end piece mold members, an opening in said rotary plate means dimensioned and configured to matingly receive and support said open transverse end of one of said end piece mold members.

23. An invert forming system for forming custom inverts in a partially completed manhole formed of a cylindrical wall having a vertical axis and a plurality of pipe openings, and a base or floor portion closing a lower end of said manhole, said system comprising:

an elongated mold member free of supplemental bracing for holding said member in position during invert formation, said member having a generally U-shaped outer surface extending in bridge-like manner between two of said pipe openings;

mold members support means adjacent to each of said two pipe openings each comprising an internal frame dimensioned to snugly engage an inner surface of said cylindrical wall, an opening in said frame being dimensioned to surround one of said pipe openings in said cylindrical wall, retaining means for clamping said internal frame in a fixed position on said cylindrical wall with said pipe opening being surrounded by said opening in said frame;

plate means attached to said internal frame for supporting one end of said elongated mold member, said plate means including a central opening configured to matingly receive one end of said elongated mold member;

rotary bearing means on said internal frame for supporting said plate means for rotation about an axis approximately parallel to an axis of the pipe opening with which the internal frame is associated; and wherein said elongated mold member comprises a plurality of hollow connectable polyurethane mold members arranged in an end-to-end aligned array, each hollow connectable mold member including end wall means extending transversely to a lengthwise axis thereof, and a lengthwise extending U-shaped trough member having first and second ends, said end wall means extending transversely of said U-shaped trough member adjacent at least one of said ends;

said end wall means each having a plurality of apertures and an upper linear edge portion adjacent upper linear edge portions of said U-shaped trough member and extending transversely across a substantial width of the hollow connectable mold member; and bolt means extending through alignment apertures in said end wall means of adjacent hollow connectable mold members for clamping said end wall means of a plurality of said hollow connectable mold members together to provide a rigid self-sustaining invert and mold extending in a bridge-like manner between two of said pipe openings.

24. The invert forming system of claim 23 wherein said hollow connectable mold members are formed of polyurethane and said end wall means and said U-shaped trough members have a wall thickness of at least approximately 0.375inches.

25. The invert forming system of claim 24 wherein said U-shaped trough members comprise a cylindrical lower portion having an angular extent of approximately 180° and upper planar panel portions canted outwardly and upwardly.

* * * * *